US008112829B2

(12) United States Patent
Shieh

(10) Patent No.: US 8,112,829 B2
(45) Date of Patent: Feb. 14, 2012

(54) FLUSH VALVE ASSEMBLY STRUCTURE OF WATER TANK

(75) Inventor: Ching-Chen Shieh, Taichung County (TW)

(73) Assignee: Globe Union Industrial Corp., Taichung County (TW)

( * ) Notice: Subject to any disclaimer, the term of this patent is extended or adjusted under 35 U.S.C. 154(b) by 631 days.

(21) Appl. No.: 12/348,427

(22) Filed: Jan. 5, 2009

(65) Prior Publication Data

US 2010/0170031 A1 Jul. 8, 2010

(51) Int. Cl.
*E03D 1/34* (2006.01)
*E03D 1/35* (2006.01)

(52) U.S. Cl. ..... 4/397; 4/399; 4/378

(58) Field of Classification Search ..... 4/400–404, 4/397, 399, 378, 328
See application file for complete search history.

(56) References Cited

U.S. PATENT DOCUMENTS

| | | | | |
|---|---|---|---|---|
| 2,795,237 | A * | 6/1957 | Corbin, Jr. | 137/433 |
| 6,715,162 | B2 * | 4/2004 | Han et al. | 4/391 |
| 6,782,975 | B1 * | 8/2004 | Whittur | 187/240 |
| 2007/0101485 | A1 | 5/2007 | Denzin | |
| 2008/0282457 | A1 * | 11/2008 | Denzin | 4/397 |

* cited by examiner

*Primary Examiner* — Gregory Huson
*Assistant Examiner* — Erin Deery
(74) *Attorney, Agent, or Firm* — Morris Manning & Martin LLP; Tim Tingkang Xia, Esq.

(57) ABSTRACT

A flush valve assembly structure of a water tank is provided, and includes a valve seat, a guide rod, and a canister flush valve. The canister flush valve seals a flow path from an internal of the water tank to a toilet bowl, and may be lifted up to be separated from the valve seat to form a valve port. A water passage part is mounted on the canister flush valve, and a water passage post is disposed on the water passage part. A water inlet is disposed on the water passage post, which may be appropriately blocked by a block wall correspondingly disposed on the bottom wall. Meanwhile, a position of the water passage post may be adjusted to change a degree that the water inlet is blocked, so as to change a flow volume of flush water entering the canister flush valve from the water inlet.

19 Claims, 11 Drawing Sheets

FLUSH VALVE ASSEMBLY STRUCTURE OF WATER TANK

BACKGROUND OF THE INVENTION

1. Field of Invention

The present invention relates to the technical field of water tank parts of a flush toilet, and more particularly to a flush valve assembly structure installed in a water tank and capable of adjusting a flush water volume conveniently.

2. Related Art

According to flush toilet standards in different countries, it is desired a flush toilet may reduce the flush water volume each time in the flushing operation to save water and protect the environment. Therefore, in current flush toilet designs, mostly the flushing intensity is increased and the flushing time is reduced, so as to ensure that the toilet bowl may be cleansed while satisfying the spirit of environmental protection. Normally, a common design is to install a flush valve assembly on a bottom of a water tank.

US Patent No. 20070101485A1 entitled "CANISTER FLUSH VALVE" has disclosed such a structure. The flush valve assembly is normally fixed on a bottom of a water tank by a valve seat. In a normal state, the flush valve assembly blocks and seals a tank outlet on the bottom of the water tank and linking the water tank and a toilet bowl, so as to form a closed space for storing clean flush water in the water tank. When an operator pulls a trip lever, or presses a flush button, a canister flush valve on the flush valve assembly is lifted to be separated from the valve seat, so as to form a valve port through which the flush water flow in the water tank flushes the toilet bowl. In a later period of the flushing process, the flush water in the water tank reduces to a lower level, so the flush valve may be opened, and the valve port is closed. Then, the water is supplemented to prepare for the next flushing.

In a current flush valve assembly, a through hole is arranged in a bottom of the canister flush valve. When the valve port is opened and most of the flush water flows to the toilet bowl, a small amount of water flows into the canister flush valve from the through hole, and accumulates in a chamber between an outer cylindrical wall and an inner cylindrical wall. Thus, the accumulated flush water increases the weight of the canister flush valve, so the canister flush valve may drop more rapidly, and the valve port is closed at a higher speed. Thus, the flush water volume used each time is reduced. However, the standards for the flush water volume used each time of the flush toilet are different in different countries, so the design that the flush water flows into the canister flush valve to increase the weight of the canister valve cannot meet the standards specified in all countries. Therefore, it is necessary to develop other designs that may increase the weight of the canister valve, so as to change the speed of closing the valve port and change the flush water volume used each time.

In addition, for water tanks of different sizes, as the capacities of the water stored in the water tanks are different, the speeds of closing the valve ports are also different. Therefore, the application lacks flexibility, and the speed for closing the valve port and the flush water volume used each time cannot be adjusted flexibly for different conditions. Thus, it is necessary to further design a flush valve assembly structure that may adjust the flush water volume conveniently.

Further, in a current flush valve assembly, the canister flush valve is often sleeved on a guide rod, and a guide edge on the guide rod is used to guide the canister flush valve, such that the canister flush valve may be lifted up and return to the original position smoothly each time. However, in the existing guide rod design, a top end of the guide edge is approximately at the same level as a bottom edge of an annular wall surface in a round rod shape in a top end segment of the guide rod. Therefore, when the canister flush valve is lifted up, the top edge of the inner cylindrical wall may easily be stuck by a bottom plane at the intersection of the annular wall surface in the round rod shape and the top end of the guide edge, which leads to error operation of the canister flush valve, or influences the smoothness of the flushing operation. These problems also need to be solved.

SUMMARY OF THE INVENTION

The present invention is directed to a flush valve assembly structure of a water tank, which generates an umbrella-shaped spray water flow from a part of flush water entering a spraying assembly at a top end of a guide rod in a later period of a flushing process when a water inlet valve is opened. Thus, the umbrella-shaped spray water flow may enter a chamber of the canister flush valve smoothly, so as to increase a weight of the canister flush valve, shorten a valve port closing time, and reduce a flush water volume used each time. Further, a fine noise-prevention effect is achieved in a process for forming a water seal required by a toilet bowl.

The present invention is also directed to a flush valve assembly structure of a water tank, which is capable of adjusting a speed of closing a valve port by a canister flush valve conveniently in each flushing operation, so as to adjust and control a flush water volume used in each flushing operation.

The present invention is further directed to a flush valve assembly structure of a water tank, in which when a force is applied on the canister flush valve to lift up the canister flush valve, a top edge of an inner cylindrical wall smoothly arrives at a round rod portion of a guide rod instead of being stuck by an intersection of the round rod portion and a guide portion, so as to ensure smoothness of an flushing operation.

To achieve the above objectives, the present invention provides a flush valve assembly structure of a water tank, which includes a valve, a guide rod, a canister flush valve, and a water passage part.

The valve seat is mounted and fixed on the water tank, and has a longitudinal through hole and a support rib extending into the longitudinal through hole.

A bottom end of the guide rod has a fixing portion, which is mounted and fixed on the support rib of the valve seat, and a guide portion is disposed above the fixing portion.

The canister flush valve seals the longitudinal through hole of the valve seat in a normal state, and has an annular bottom wall. Inner and outer sides of the bottom wall extend upward to form an inner cylindrical wall and an outer cylindrical wall respectively, so as to define an annular chamber by the inner cylindrical wall, the outer cylindrical wall, and the bottom wall, and flush water is sprayed into the chamber. An inner edge surface of the inner cylindrical wall is guided and positioned by the guide portion of the guide rod, at least one via in a predetermined shape is arranged in the bottom wall, and a periphery of the via extends upward appropriately to form a block wall. The canister flush valve may have an upward displacement along the guide portion of the guide rod, so as to be separated from the valve seat to form a valve port; a spraying assembly, which is mounted and fixed on a top end of the guide rod. A part of supplemented flush water appropriately flows into the spraying assembly, and then forms the umbrella-shaped spray water flow and flows into the chamber of the canister flush valve.

A round rod portion is disposed on the top end of the guide rod of the flush valve assembly structure of the water tank, so as to form a round annular wall surface. The round rod portion extends downward to form the guide portion, and a plurality of guide rib plates distributed at equal angles is formed around the guide portion. A guide edge is formed at an edge of each of the guide rid plates. Top ends of the guide edges of the guide rib plates connected to the annular wall surface slightly protrude from the annular wall surface radially, and extend upward with small segments on the annular wall surface.

In the flush valve assembly structure of a water tank of the present invention, by using the spraying assembly mounted at the top end of the guide rod, in the later period of the flushing process when the water inlet valve is opened, a part of the flush water flowing into the spraying assembly may form an umbrella-shaped spray water flow, and flow into the chamber, so as to increase the weight of the canister flush valve, and reduce the time when the canister flush valve drops to close the valve port. Further, by adjusting the relative positions of the water inlet of the water passage post of the water passage part and the block wall around the via of the canister flush valve, the volume of the flush water in the water tank flowing into the chamber through the water passage post after the valve port is opened may be adjusted, so as to adjust the closing time of the valve port. Thus, the standards in different countries can be satisfied. In addition, after the valve port is closed, the umbrella-shaped spray water flow may provide the water seal required by the toilet bowl, and as the umbrella-shaped spray water flow flows down along the inner wall surface of the outer cylindrical wall, no noise is generated when the water flows, and a fine noise-prevention effect is achieved in the process of forming the water seal.

Moreover, the top ends of the guide edges of the guide rod portion slightly protrude radially and extend to the annular wall surface of the round rod portion longitudinally, so when a force is applied on the canister flush valve to lift up the canister flush valve, top edges of the inner cylindrical wall may arrive at the round rod portion smoothly, and will not be stuck by a bottom surface of the round rod portion at the intersection of the round rod portion and the guide portion, which ensures that each flushing operation is smoothly and stably performed.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
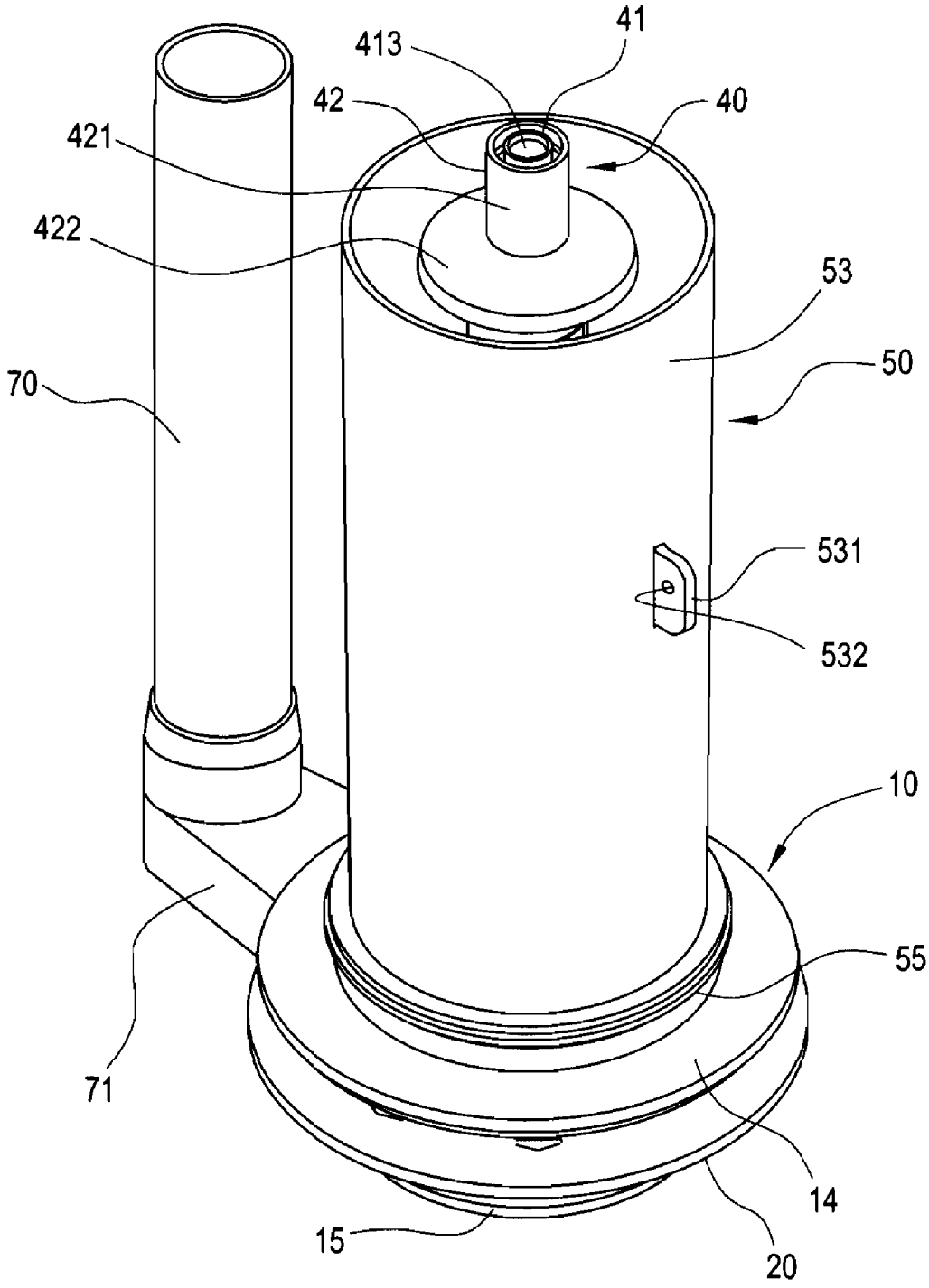
FIG. 1 is a combined outside view of the flush valve assembly of the present invention.
Figure 2:
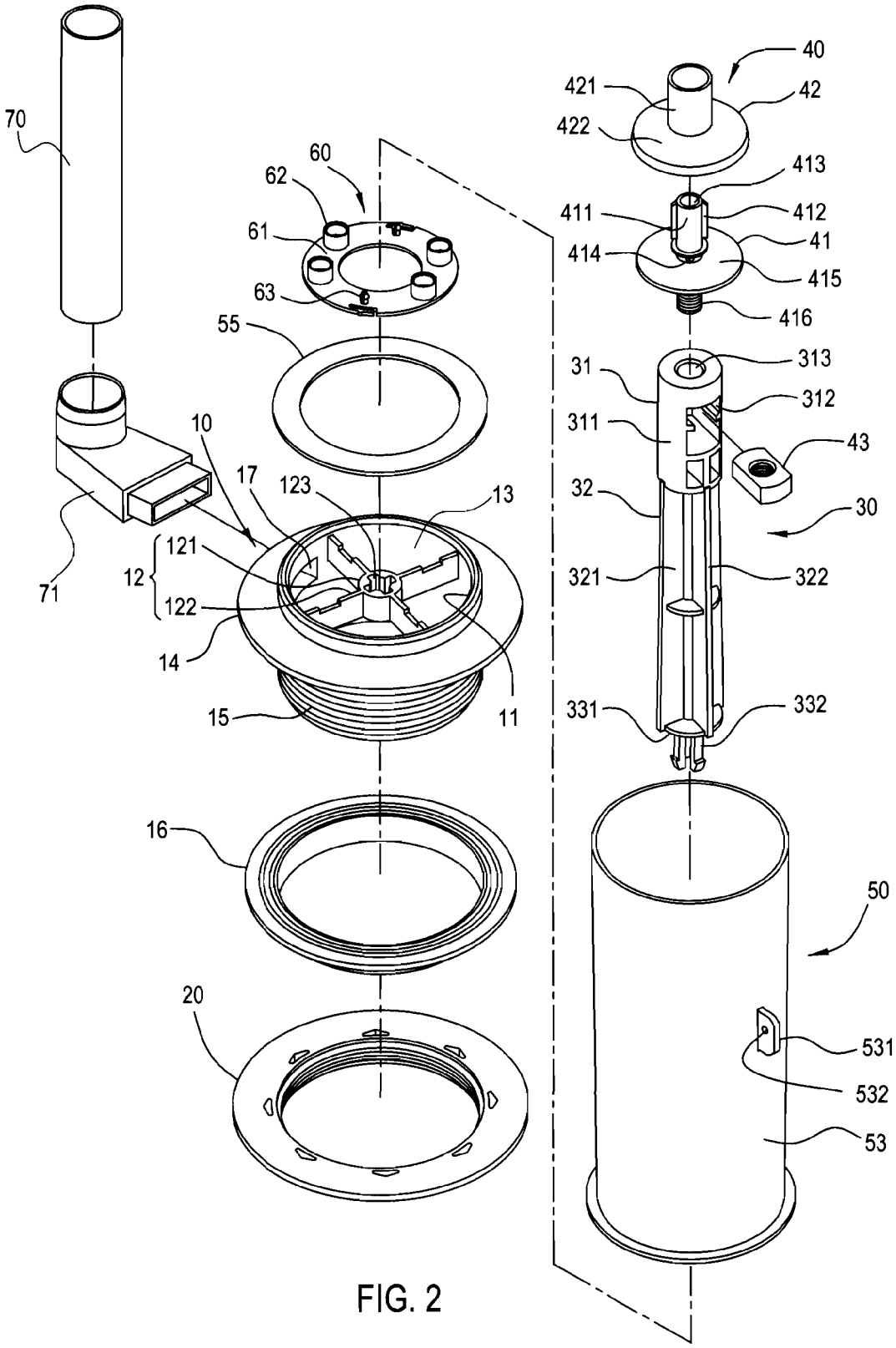
FIG. 2 is a three-dimensional exploded view of the flush valve assembly of the present invention.
Figure 3:
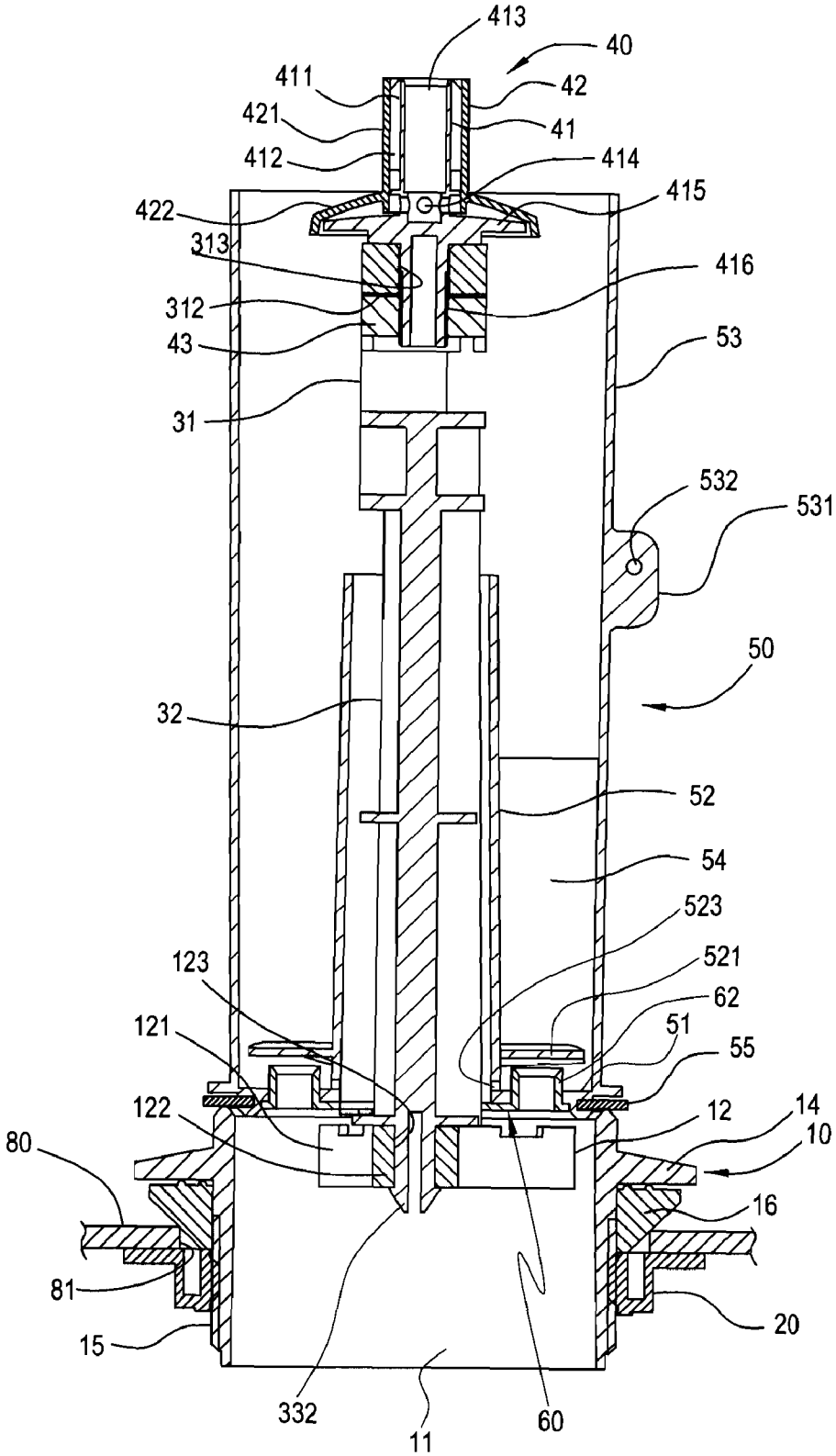
FIG. 3 is a combined cross-sectional view of the flush valve assembly mounted on a bottom wall of the water tank of the present invention.

FIGS. 1 to 3 are structural views of a flush valve assembly structure of a water tank according to a preferred embodiment of the present invention. FIG. 1 is a combined outside view of the flush valve assembly of the present invention, FIG. 2 is a three-dimensional exploded view of the flush valve assembly of the present invention, and FIG. 3 is a combined cross-sectional view of the flush valve assembly mounted on a bottom wall of the water tank of the present invention.

The flush valve assembly is mounted and fixed on a mounting hole 81 of the bottom wall 80 of a common water tank (as shown in FIG. 3). The flush valve assembly mainly includes a valve seat 10, a locking member 20, a guide rod 30, a spraying assembly 40, a canister flush valve 50, a water passage part 60, and an overflow pipe 70.

The valve seat 10 is approximately tube-shaped, and has a longitudinal through hole 11. A support rib 12 extends in the longitudinal through hole 11. In this embodiment, the support rib 12 is formed by four rib plates 121 arranged in a cross shape and a pipe post 122 connecting the rib plates 121 at the center. A cross-shaped positioning perforation 123 is arranged through the pipe post 122. Meanwhile, the support ribs 12 define a plurality of flow paths 13 in an inner wall of the longitudinal through hole 11. A pressing plate 14 extends from an outer edge near an upper part of the valve seat 10 radially, and the valve seat 10 has an external screw thread 15 below the pressing plate 14, for passing through the fixing hole 81 in the bottom wall 80 of the water tank. A water proof washer 16 is sleeved on the outer edge of the valve seat 10 below the pressing plate 14.

The locking member 20 is screwed on the external screw thread 15 of the valve seat 10 passing through the mounting hole 81 of the water tank. The valve seat 10 is locked to the bottom wall 80 of the water tank, and the water proof washer 16 sleeved on the valve seat 10 is fixed and pressed between the bottom wall of the pressing plate 14 and the corresponding bottom wall 80 of the water tank.

Figure 4:
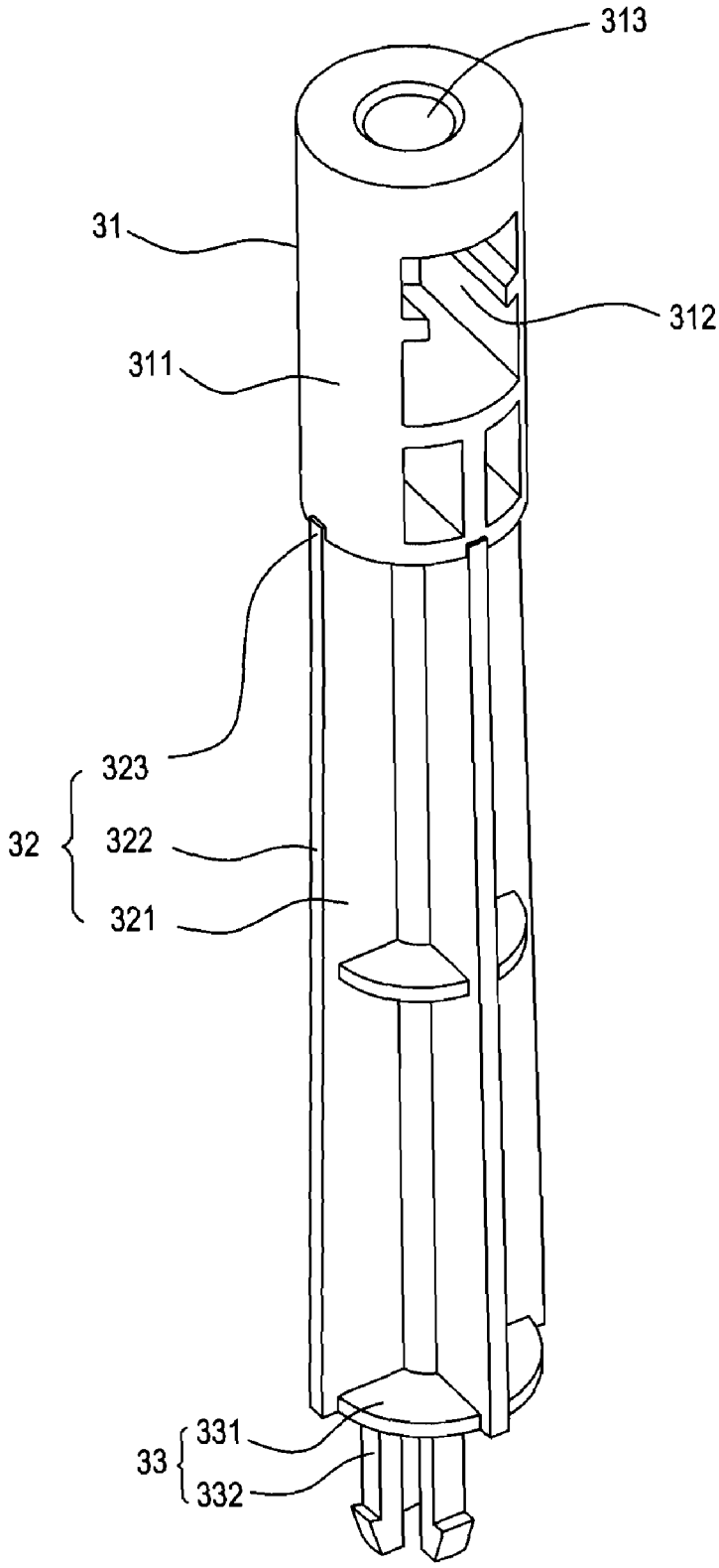
FIG. 4 is a three-dimensional outside view of a guide rod of the present invention.

FIG. 4 is a three-dimensional outside view of a guide rod of the present invention. Referring to FIG. 4, the guide rod 30 includes a round rod portion 31, a guide portion 32, and a fixing portion 33 sequentially from the top end to the bottom. The round rod portion 31 has a round annular wall surface 311, a transverse rabbet 312 is disposed through the annular wall surface 311 at an appropriate position, and an insertion hole 313 in communication with the transverse rabbet 312 is disposed on the top end of the round rod portion 31. The round rod portion 31 extends downward to form the guide portion 32, and four guide rib plates 321 are disposed at a periphery of the guide portion 32 at equal angles. A guide edge 322 is formed at an edge of each of the guide rid plates 321. Top ends 323 of the guide edges 322 of the guide rib plates 321 connected to the annular wall surface 311 slightly protrude from the annular wall surface 311, and extend upward with small segments on the annular wall surface 311. The guide portion 32 extends downward to form the fixing portion 33, and an annular block wall 331 extending in a radial direction is formed on the fixing portion 33. The annular block wall 331 bears against a top surface of the pipe post 122 of the valve seat 10 to limit the position of each other. Further, four clips 332 arranged in a cross shape are disposed below the annular block wall 331, which may be engaged with the cross-shaped positioning perforation 123 of the pipe post 122 of the valve seat 10 to fix each other, and to limit the rotation of the guide rod 30, so as to fix the guide rod 30 on the valve seat 10.

Figure 5:
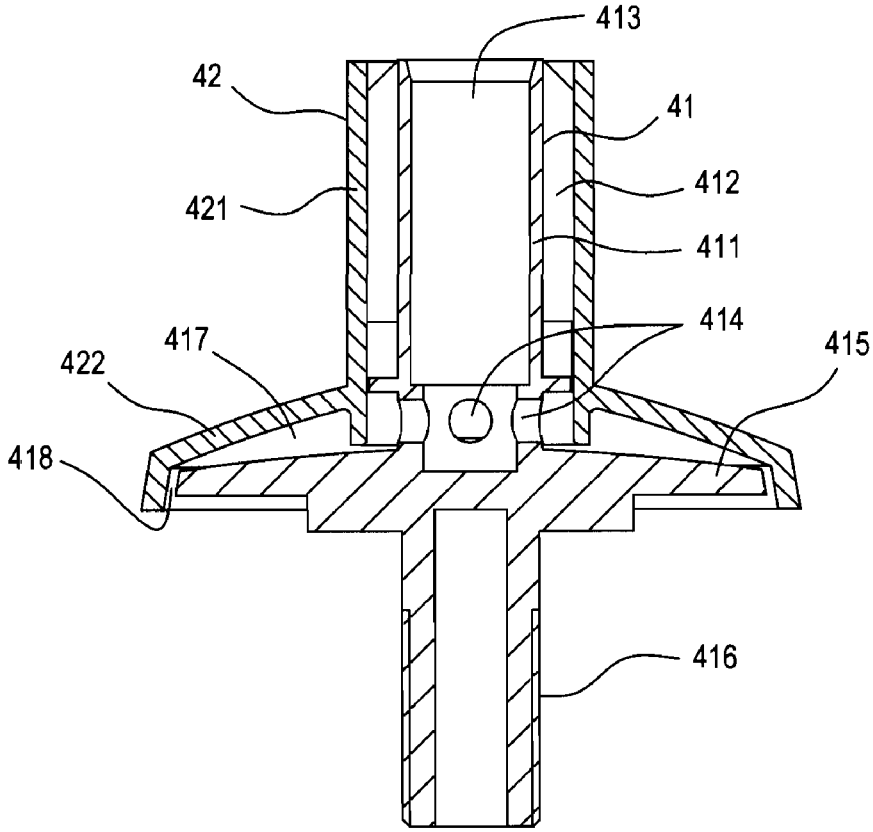
FIG. 5 is a cross-sectional side view of a spraying part and a cover in a combined state of the present invention.
Figure 12:
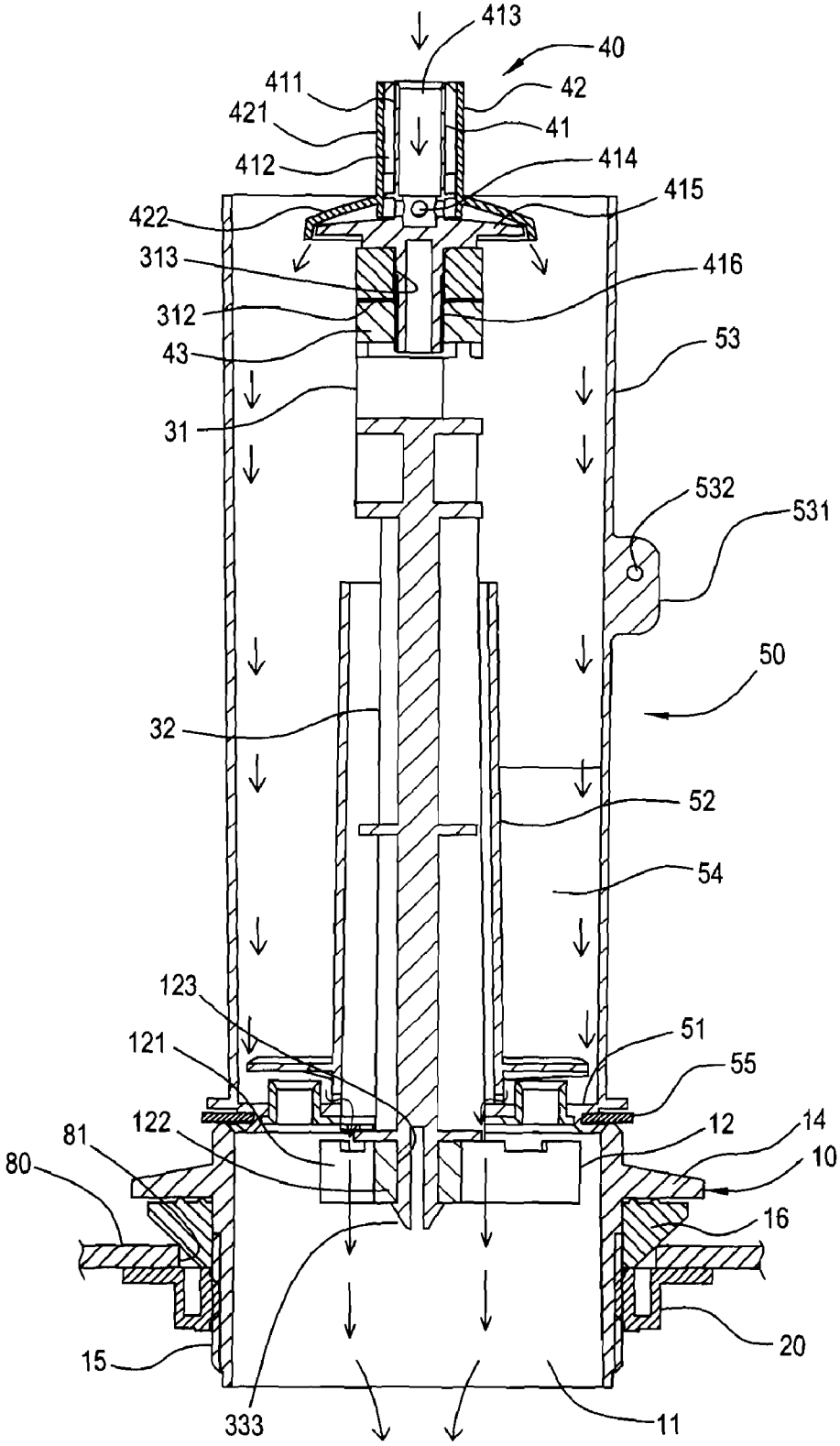
FIG. 12 is a schematic view of the canister flush valve of the present invention in a state that the flushing operation is completed and the valve port is closed, and in a state that the umbrella-shaped spray water flow generated by the spraying part flows to the valve seat along the inner cylindrical wall.

FIG. 5 is a cross-sectional side view of a spraying part and a cover in a combined state of the present invention. The spraying assembly 40 includes a spraying part 41, a cover 42, and a locking block 43. The spraying part 41 has a positioning tube post 411, which has four positioning ribs 412 distributed at equal angles on a peripheral wall, and has a water inlet 413 on a top end. The water inlet 413 provides a pipeline communication of the flush water, so as to receive the flush water appropriately. Four spraying holes 414 are arranged through the peripheral wall of the positioning tube post 411 at equal angles, which may be in communication with the water inlet 413. A receiving plate 415 extends outward from the peripheral wall of the positioning pipe post 411 below the spraying holes 414 radially, and a stud 416 that may be inserted into the insertion hole 313 at the top end of the guide rod 30 extends from the lower part of the receiving plate 415. The cover 42 has a positioning bushing 421, which sleeves on and is positioned by the positioning pipe post 411 of the spraying part 41, such that an inner wall of the positioning bushing 421 is pressed against the positioning ribs 412 on the peripheral wall of the positioning pipe post 411 for positioning. In addition, a hood-shaped cover plate 422 slightly inclining downward extends outwards from the bottom end of the positioning bushing 421 radially, which covers the receiving plate 415 from the above, such that an annular flow path 417 in communication with the spraying holes 414 and an annular spraying nozzle 418 inclining downward are defined between the cover plate 422 and a top surface of the receiving plate 415. Thus, the flush water from the water inlet 413 may be sprayed downward in an umbrella shape, as shown in FIG. 12. The locking block 43 may be inserted into and fixed in the transverse rabbet 312 near the top end of the guide rod 30, and may be screwed with the stud 416 inserted to the bottom end of the spraying part 41 through the insertion hole 313 at the top end of the guide rod 30.

Figure 6:
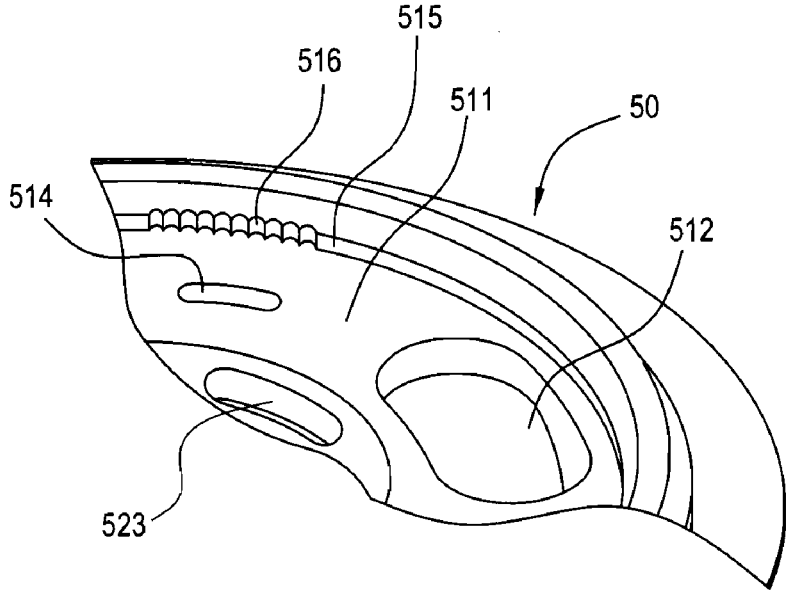
FIG. 6 is a partial bottom view of the canister flush valve of the present invention.
Figure 7:
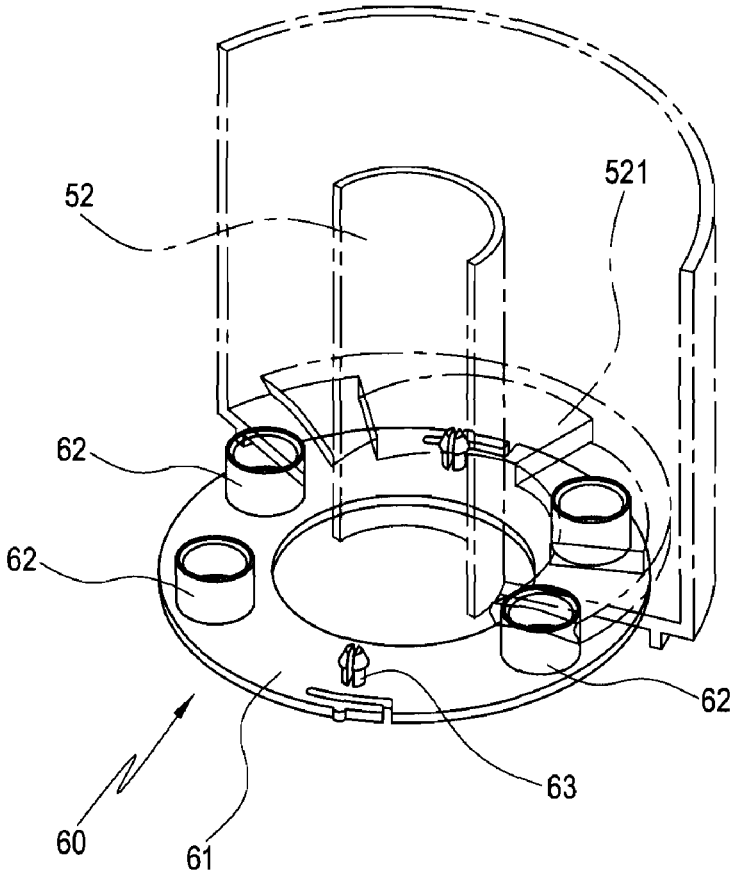
FIG. 7 is a partial schematic structural view of a water passage part and the canister flush valve in a combined state of the present invention.
Figure 8:
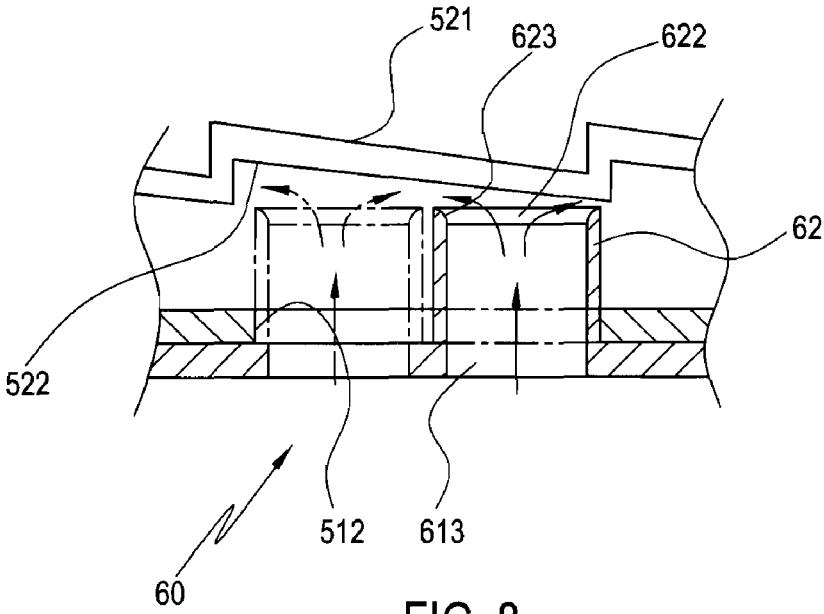
FIG. 8 is a top view of the water passage part and the canister flush valve in a combined state of the present invention.

FIG. 6 is a partial bottom view of the canister flush valve of the present invention, FIG. 7 is a partial schematic structural view of a water passage part and the canister flush valve in a combined state of the present invention, and FIG. 8 is a schematic expanded planar view of the water passage part and the canister flush valve structure of the present invention.

The canister flush valve 50 is cylinder-shaped, and has an annular bottom wall 51. An inner cylindrical wall 52 and an outer cylindrical wall 53 extend from inner and outer sides of the bottom wall 51 respectively, so as to define an annular chamber 54 in the inner cylindrical wall 52, the outer cylindrical wall 53, and the bottom wall 51. A part of the flush water flows into the chamber 54.

An annular attaching surface 511 depresses from the bottom surface of the bottom wall 51, as shown in FIG. 6. The attaching surface 511 has four arc-shaped vias 512 extending along a circumferential direction. Further, two positioning grooves 514 in an arc hole shape and extending along the circumferential direction are symmetrically disposed through the attaching surface 511 at appropriate positions. A plurality of positioning tooth grooves 516 are formed at two symmetric parts on a step wall 515 around the attaching surface 511.

The inner cylindrical wall 52 sleeves on the guide rod 30, and the inner edge of the inner cylindrical wall 52 is appropriately guided and positioned by the guide edges 332 on the guide rod 30. A baffle 521 radially protrudes from the inner cylindrical wall 52 at a position at a predetermined distance to the bottom wall 51. A block wall 522 corresponding to each of the vias 512 is formed on the baffle 521. Each block wall 522 extends downward from one end to the other end of the via 512 in an inclined manner. A plurality of water outlets 523 through the chamber 54 is disposed at a junction of the inner cylindrical wall 52 and the bottom wall 51.

Figure 11:
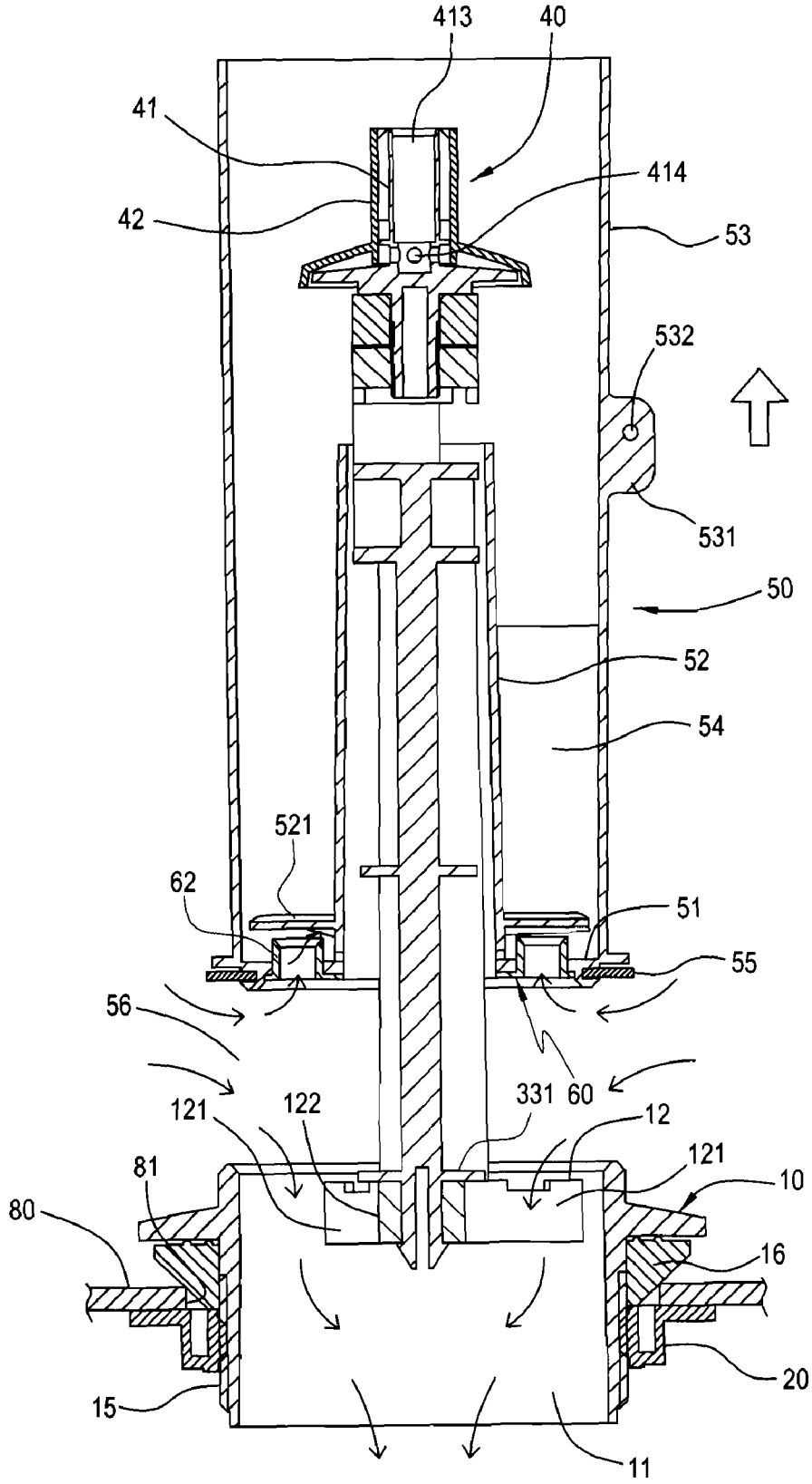
FIG. 11 is a schematic view of the motion that the canister flush valve is lifted up and is separated from the top edge of the longitudinal through hole of the valve set to form a valve port of the present invention.

A water proof washer 55 is embedded on the canister flush valve 50 approximately at the bottom end of the outer cylindrical wall 5. In a normal state, the water proof washer 55 urges against and seals the top edge of the longitudinal through hole 11 of the valve seat 10. A bump 531 extends from a peripheral wall of the outer cylindrical wall 53. A pulling hole 532 is arranged in the bump 531, which may be connected to a chain or a lever (not shown), so as to be driven by the operation. Thus, the canister flush valve 50 may be properly pulled up, such that the water proof washer 55 is separated from the top edge of the valve seat 10 to form a valve port 56, as shown in FIG. 11.

Figure 9:
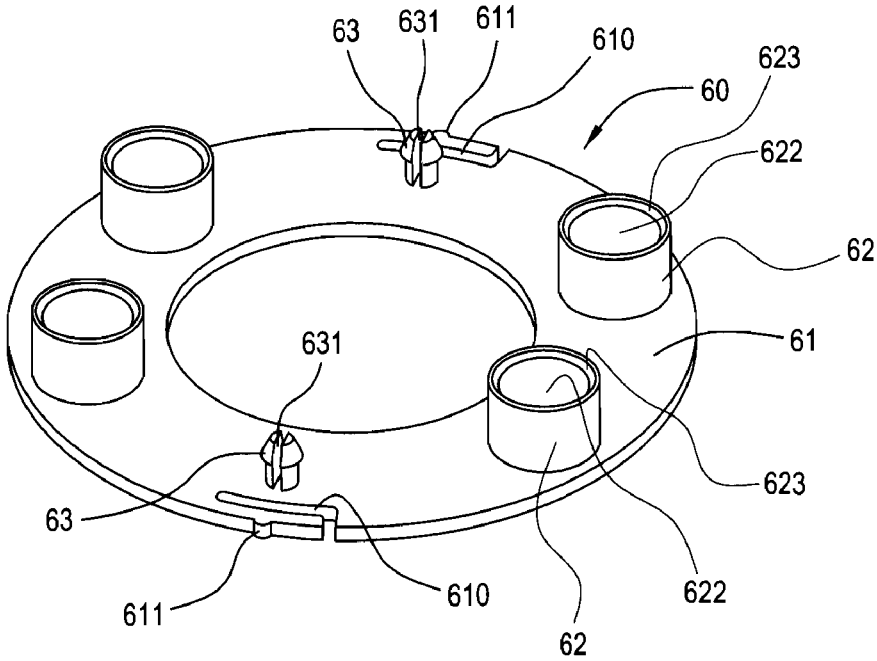
FIG. 9 is a three-dimensional outside view of the water passage part of the present invention.
Figure 10:
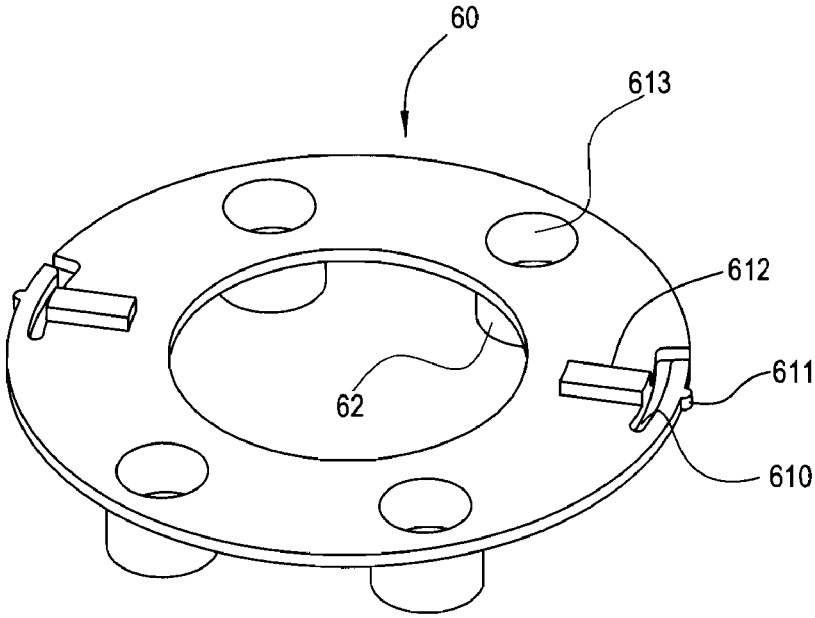
FIG. 10 is a bottom view of the water passage part of the present invention.

FIG. 9 is a three-dimensional outside view of a water passage part of the present invention, and FIG. 10 is a bottom view of the water passage part of the present invention. Referring to FIGS. 9 and 10, the water passage part 60 has a sheet-shaped annular portion 61, which is attached on the attaching surface 511 on the bottom of the canister flush valve 50, and is engaged with the step wall 515 around. A bump 611 corresponding to each of the positioning tooth grooves 516 is disposed on the periphery of the annular portion 61, and a groove 610 corresponding to each of the bumps 611 is opened in the annular portion 61. The grooves 610 extend inward from the outer edge of the annular portion 61, and further extend a distance in a direction approximately parallel to the outer edge of the annular portion 61, such that the annular portion 61 has a space that allows a part of the bumps 611 to have an inward elastic deformation. Thus, the bumps 611 may be engaged with and positioned by the positioning tooth grooves 516. Meanwhile, a detent bump 612 is disposed at two symmetric positions on the bottom surface of the annular portion 61 respectively, as shown in FIG. 10, such that the operator may apply a pulling force to adjust the position of the water passage part 60.

A through hole 613 is disposed at positions corresponding to the vias 512 on the annular portion 61 respectively, and a water passage post 62 integrally extends upward from the top end of each of the through holes 613 on the annular portion 61. Thus, the water passage posts 62 may extend upward through the vias 512 of the bottom wall 51, as shown in FIGS. 7 and 8, and have an arc displacement in the vias 512 along with the rotation adjustment of the water passage part 60. A water inlet 622 in communication with the through holes 613 on the bottom is formed on each of the water passage posts 62, and an arc protrusion 623 is formed on the inner edge of each of the water passage posts 62 at a position corresponding to the water inlets 622, such that the water inlet 622 is in a shape that gradually expands upward. Moreover, the displacement of the water passage posts 62 may change the distance to the block walls 522 (as shown in FIG. 8). Insertion posts 63 extend from the top surface of the annular portion 61 at positions corresponding to the positioning grooves 514 respectively. The top ends of the insertion posts 63 are approximately reverse hook-shaped, and a slot 631 is cut in the top end of each of the insertion posts 63. Thus, the top ends may be elastically compressed to pass through the positioning grooves 514 of the bottom wall 51, and then recover and expand to be engaged with and positioned by the top surface of the bottom wall 51, so as to mount and fix the water passage part 60 on the bottom wall 51 of the canister flush valve 50. Meanwhile, the insertion posts 63 may also be adjusted along with the rotation of the water passage part 60, so as to have an arc displacement in the positioning grooves 514. In the water passage part 60 according to this embodiment of the present invention, the bumps 611 around are engaged with the corresponding positioning tooth grooves 516 disposed on the bottom of the canister flush valve 50, so as to provide multi-step adjustment and positioning. In other words, when the bumps 611 and the positioning tooth grooves 516 are not used, the stepless adjustment may be achieved, which also meets the technical spirit of the present invention.

Finally, referring to FIG. 2, a connection base 71 is disposed at the bottom of the overflow pipe 70. The connection base 71 is hollow, and is in communication with the overflow pipe 70. Further, a socket 17 corresponding to the connection base 71 is disposed on the valve seat 10. The socket 17 passes through the valve seat in an approximately parallel direction, such that the overflow pipe 70 and the connection seat 71 are in communication with the flow path 13.

The flush valve assembly of a water tank of the present invention is mounted at the mounting hole 81 in the bottom wall 80 of a common water tank. When the operator pulls a trip lever or presses a flush button, the canister flush valve 50 may be pulled up through the chain or lever, such that the water proof washer 55 on the bottom of the canister flush valve 50 is separated from the top edge of the longitudinal through hole 11 of the valve seat 10, so as to form a valve port 56, as shown in FIG. 11. Thus, the clean flush water accumulated in the water tank flows through the valve port 56 and the flow path 13 formed in the longitudinal through hole 11 of the valve seat 10 into the toilet bowl for flushing the toilet. In the early period after the canister flush valve 50 is lifted up, the bottom is much lower than the flush water in the water tank. Therefore, most of the flush water will flow to the valve seat 10 through the valve port 56, while a small part of the flush water will flow into and be accumulated in the chamber 54 through the through holes 613 in the water passage part 60 on the bottom of the canister flush valve 50 and the water inlets 622 of the water passage posts 62. After the canister flush valve 50 is released, the weight of the accumulated flush water in the chamber 54 increases the speed that the canister flush valve 50 drops, such that the canister flush valve 50 closes the valve port 56 in a shorter time, as shown in FIG. 12, which enables the flush water volume to meet the standards of different countries.

FIG. 12 is a schematic view of the canister flush valve of the present invention in a state that the flushing operation is completed and the valve port is closed, and in a state that the umbrella-shaped spray water flow generated by the spraying part flows to the valve seat along the inner cylindrical wall. According to the design of the spraying assembly 40 of the present invention, when the flush water in the water tank reduces to a low level, and the water inlet valve is opened, the generated umbrella-shaped spray water flow is used to provide the flush water to the chamber 54 of the canister flush valve 50, so as to increase the weight of the flush water accumulated in the chamber 54, and increase the speed that the canister flush valve 50 drops. Thus, the canister flush valve 50 may close the valve port 56 in a shorter time. The spraying assembly 40 of the present invention may greatly shorten the closing time of the valve port 56.

The water passage part 60 of the present invention is arranged to adjust the closing time of the valve port 56. As the standards in different countries are also different, by rotating the water passage part 60 to adjust its position, the distance between the water inlets 622 of the water passage posts 62 and the block walls 522 may be changed, so as to control the total volume of the water flow in a unit time. When the distance between the water inlets 622 and the block walls 522 is greater, the weight of the flush water accumulated in the chamber 54 in a short time will be greater, such that the canister flush valve 50 drops at a higher speed, and the valve port 56 is closed in a shorter time. On the contrary, when the distance between the water inlets 622 and the block walls 522 is smaller, the valve port 56 will be closed in a longer time. Certainly, the change of the distance between the water inlets 622 of the water passage posts 62 and the block walls 522 also influence the buoyancy on the canister flush valve 50 to some extent. When the distance between water inlets 622 and the block walls 522 is smaller, the buoyancy is greater; when the distance between the water inlets 622 and the block walls 522 is greater, the buoyancy is smaller, that is, the canister flush valve 50 will drop at a higher speed.

In addition, after the water passage part 60 is mounted, the adjustment to the closing speed of the valve port 56 may be performed conveniently in actual operations. By lifting up the canister flush valve 50 to a height that allows the user to extend hands into the bottom, and appropriately pulling and turning the two detent bumps 612 on the bottom of the water passage part 60, the water passage posts 622 of the water passage part 60 may have arc displacement in the vias 512 of the canister flush valve 50, so as to change the distance between the water inlets 622 and the block walls 522. After the adjustment and positioning, the canister flush valve 50 is released to perform the actual operations until the standards are satisfied. Thus, the adjustment operation is completed conveniently.

Moreover, when the water passage part 60 uses the multi-step adjustment structure according to the preferred embodiment, in the adjustment operation, the desired position may be achieved through the engagement between the bumps 611 of the water passage part 60 and the positioning tooth grooves 516 of the canister flush valve 50.

In the later period of the flushing process of the present invention, as the flush water in the water tank reduces to a lower level, the water tank will open the water inlet valve to supplement the water, and the canister flush valve 50 will close the valve port 56. The supplemented flush water supplements the water in the water tank, and a part of the flush water will flow into the chamber 54 through the umbrella-shaped spray water flow from the water inlet 413 of the water spraying part 41. Finally, the flush water flows to the toilet bowl from the water outlets 523 of the canister flush valve 50 through the flow path 13 of the valve seat 10, as shown in FIG. 12. When the flush water in the water tank reaches a high level, and the water inlet valve is closed, the water seal required by the toilet bowl may be formed.

The height of the overflow pipe 70 may be varied (cut) according to the capacity and form of the water tank, so as to limit the water level in the water tank, such that the water accumulated in the water tank does not overflow the water tank. That is, when the water level control mechanism of the water tank fails, if the level of the accumulated water in the water tank exceeds the top of the overflow pipe 70, the water will flow into the overflow pipe 70, and then flow into the toilet bowl through the connection seat 71 and the flow path 13.

In addition, the canister flush valve 50 also has the overflow function. When the top edge of the canister flush valve 50 is consistent with the upper limit of the water level in the water tank, the components such as the overflow pipe 70 may be omitted. When the water level is higher than the top edge of the canister flush valve 50, the water will flow into the chamber 54 of the canister flush valve 50, and then flow to the toilet bowl from the water outlets 523 through the flow path 13. At this time, the overflow pipe 70 and the connection seat 71 may be omitted, and it is only necessary to use an appropriate water plug (not shown) to seal the socket 17 of the valve seat 10.

According to the above description, the flush valve assembly structure of a water tank of the present invention has the following features and efficacies.

1. In the present invention, through the spraying assembly 40 mounted on the top end of the guide rod 30, a part of the flush water will flow into the water inlet 413 of the spraying part 41 to generate the umbrella-shaped spray water flow in the later period of the flushing process. The part of the flush water flows into the chamber 54 to further increase the weight of the accumulated flush water and reduce the time that the canister flush valve 50 drops to close the valve port 56. In addition, the umbrella-shaped spray water flow flows along the inner surface of the outer cylindrical wall 53, so as to prevent the water flow noise, especially when forming the water seal in the toilet bowl, thus achieving a fine noise-prevention effect.

2. In the present invention, the water passage part 60 is mounted on the bottom of the canister flush valve 50, which may be properly adjusted to change the water flow volume between the chamber 54 in the canister flush valve 50 and the flow path 13 of the valve seat 10. Thus, the weight of the flush water accumulated in the chamber 54 of the canister flush valve 50 in a certain time in the early period of forming the valve port 56 may be changed, so as to adjust the speed that the canister flush valve 50 drops, that is, the closing time of the valve 56 properly. Thus, the standards of different countries are satisfied.

3. In the present invention, on the guide portion 32 of the guide rod 30, the top ends 323 of the guide edges 322 slightly protrude from the annular wall surface 311 of the round rod portion 31 radially, and extend upward longitudinally for a small segment. Thus, when the canister flush valve 50 is lifted up, the top edge of the inner cylindrical wall will be guided to the round rod portion 31 smoothly, and will not be stuck by the bottom plane of the round rod portion 31 at the intersection of the round rod portion 31 and the guide portion 32, so as to ensure that each flushing operation is performed smoothly.

In addition to the water passage post of the water passage part according to the above embodiment, and the matching between the vias of the canister flush valve and the block walls, the present invention may be implemented in other forms, which are not limited to the above description. In principle, the techniques capable of appropriately adjusting the flow volume through the water inlet shall fall into the scope of the present invention.

Figure 13:
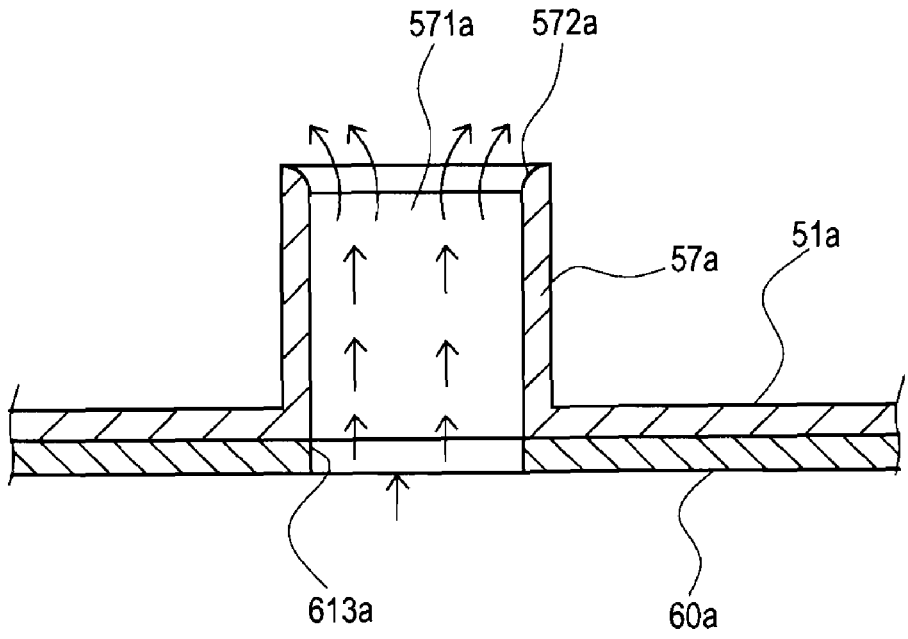
FIG. 13 is a schematic structural view of the water passage part and the bottom wall of the canister flush valve according to a second embodiment of the present invention.
Figure 14:
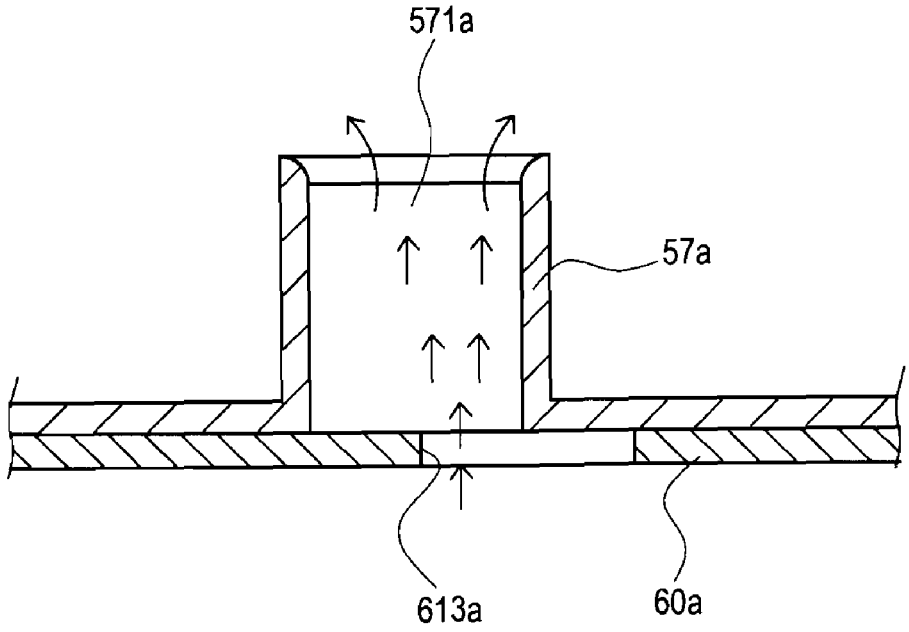
FIG. 14 is a schematic cross-sectional view of the adjustment of the water passage part according to the second embodiment of the present invention.

FIGS. 13 and 14 are schematic structural views of a second embodiment of the present invention. FIG. 13 is a schematic structural view of the water passage part and the bottom wall of the canister flush valve according to the second embodiment of the present invention, and FIG. 14 is a schematic cross-sectional view of the adjustment of the water passage part according to the second embodiment of the present invention. In this embodiment, the through holes 613*a* of the water passage part 60*a* directly pass through the water passage part 60*a*, and a water passage post 57*a* is disposed on the bottom wall 51*a* at positions corresponding to each of the through holes 613*a* respectively. The structure of the water passage post 57*a* is similar to that of the water passage post according to the first embodiment, and also has a water inlet 571*a* at the top edge thereof.

When the water passage part 60*a* is turned to have a displacement, the positions of the through holes 613*a* will be staggered with respect to the water inlet 571*a*, as shown in FIG. 14. Thus, the flow volume of the water inlet may also be adjusted, so as to achieve the same adjustment efficacy as the first embodiment.

Figure 15:
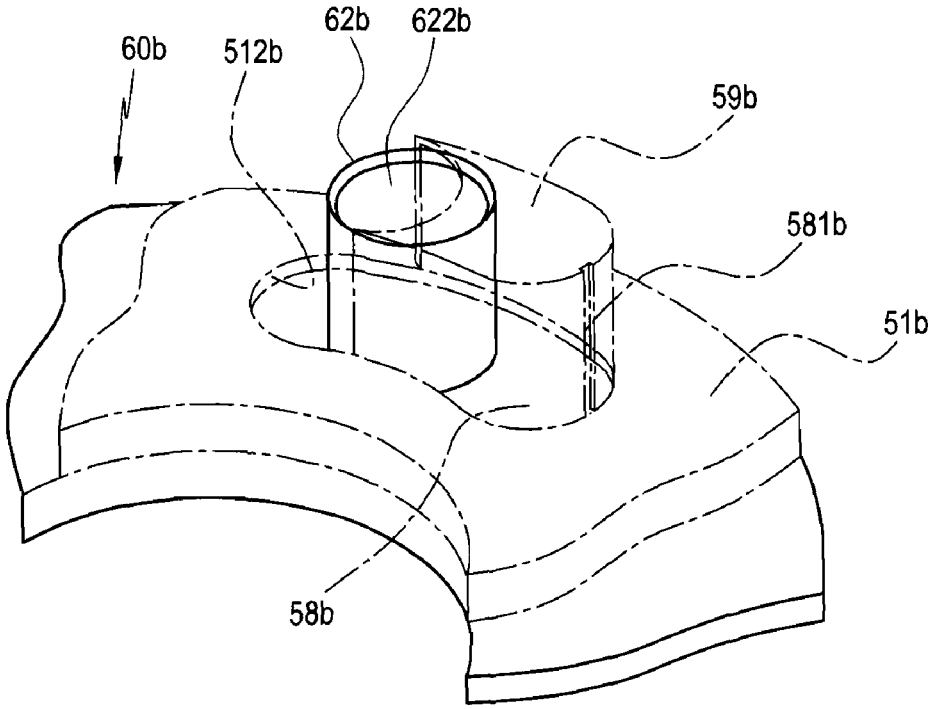
FIG. 15 is a schematic structural view of the water passage part and the bottom wall of the canister flush valve according to a third embodiment of the present invention.
Figure 16:
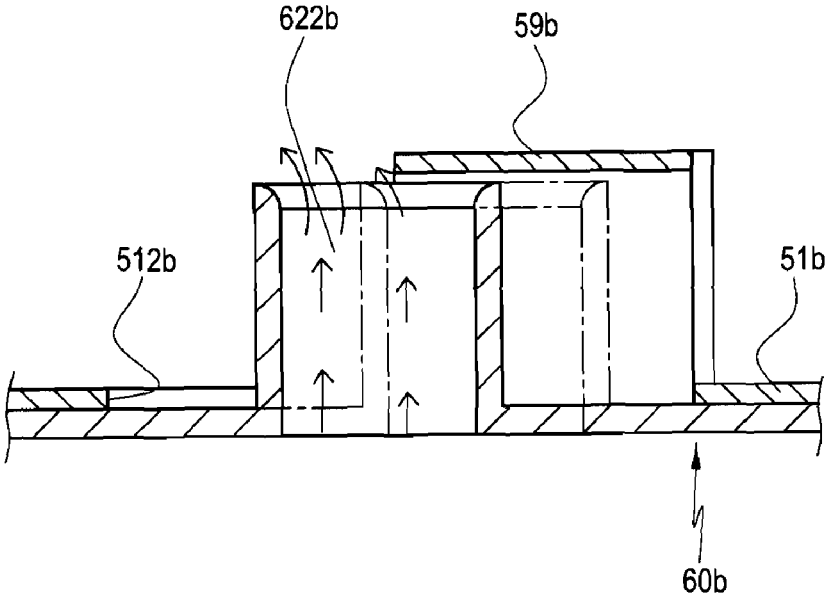
FIG. 16 is a schematic cross-sectional view of the adjustment of the water passage part according to the third embodiment of the present invention.

FIGS. 15 and 16 are schematic structural view of a third embodiment of the present invention. FIG. 15 is a schematic structural view of the water passage part and the bottom wall of the canister flush valve according to the third embodiment of the present invention, and FIG. 16 is a schematic cross-sectional view of the adjustment of the water passage part according to the third embodiment of the present invention. In this embodiment, the water passage part 60*b* also has a water passage post 62*b*, and a surrounding side wall 58*b* corresponding to the water passage post 62*b* extends upward from one end of the via 512*b* of the bottom wall 51*b*, a block wall 59*b* is formed on the top surface of the side wall 58*b*, and the side wall 58*b* does not extend to the other end of the via 512*b*. An opening 581*b* is disposed on the side wall 58*b* at an appropriate position.

When the water passage part 60*b* is turned to have a displacement, the position relationship between the water passage post 62*b* and the block wall 59*b* is changed, such that a part of the water inlet 622*b* is blocked by the block wall 59*b*, or the water inlet 622*b* is almost completely blocked by the block wall 59*b*, as shown in FIG. 14, or the water inlet 622*b* is completely not blocked by the block wall 59*b*. Thus, the flow volume of the water inlet may also be adjusted, so as to achieve the same adjustment efficacy as the first embodiment.

What is claimed is:

1. A flush valve assembly structure of a water tank, comprising:

a valve seat, mounted and fixed on the water tank, and having a longitudinal through hole, and a support rib extending into the longitudinal through hole;

a guide rod, having a fixing portion on a bottom end, wherein the fixing portion is mounted and fixed on the support rib of the valve seat, and a guide portion is disposed above the fixing portion;

a canister flush valve, closing the longitudinal through hole of the valve seat in a normal state, and having an annular bottom wall, wherein an inner cylindrical wall and an outer cylindrical wall extend upward from an inner side and an outer side of the bottom wall respectively, so as to define an annular chamber in the inner cylindrical wall, the outer cylindrical wall, and the bottom wall, and flush water flows into the chamber; an inner edge surface of the inner cylindrical wall is guided and positioned by the guide portion of the guide rod, and at least one via in a predetermined shape is arranged in the bottom wall; the canister flush valve has an upward displacement along the guide portion of the guide rod, so as to be separated from the valve seat to form a valve port; and a spraying assembly, mounted and fixed on a top end of the guide rod, wherein a part of supplemented flush water flows into the spraying assembly, and forms an umbrella-shaped spray water flow that flows into the chamber of the canister flush valve.

2. The flush valve assembly structure of a water tank according to claim 1, wherein spraying assembly comprises a spraying part, a cover, and a locking block; the spraying part comprises a positioning pipe post, a water inlet is disposed on a top end of the positioning pipe post, and at least one spraying hole in communication with the water inlet is disposed through a peripheral wall of the positioning pipe post at a predetermined position, a receiving plate extends outward from the peripheral wall of the positioning pipe post below the spraying hole radially, and a stud extends from the spraying part below the receiving plate; the cover comprises a positioning bushing sleeved on and positioned by the positioning pipe post of the spraying part, a hood-shaped cover plate slightly inclining downward extends outwards from an peripheral wall at a bottom end of the positioning bushing radially, and the cover plate approximately covers the receiving plate from the above, such that an annular flow path in communication with the spraying hole and an annular spraying nozzle inclining downward are defined between the cover plate and a top surface of the receiving plate; a transverse rabbet is disposed on a peripheral wall at the top end of the guide rod, and the locking block is engaged with and positioned by the transverse rabbet, and an insertion hole in communication with the transverse rabbet is disposed on the top end of the guide rod, such that the stud of the spraying part is inserted into the insertion hole, and is screwed with the locking block.

3. The flush valve assembly structure of a water tank according to claim 2, wherein a plurality of positioning ribs extends from the peripheral wall of the positioning pipe post of the spraying part, and the positioning ribs bear against an inner wall of the positioning bushing of the cover for being positioned.

4. The flush valve assembly structure of a water tank according to claim 1, further comprising a water passage part, wherein the water passage part comprises an annular portion that bears against a bottom surface of the bottom wall for being positioned and the water passage part can rotate in relative to the bottom wall, at least one through is arranged in the water passage part, a water passage post protrudes from a place of the water passage part or the bottom wall corresponding to the through hole, and a water inlet is formed in the water passage post, an open level of the water inlet can be controlled by rotating the water passage part in relative to the bottom wall, a plurality of water outlets through the chamber is disposed at a junction of the inner cylindrical wall and the bottom wall.

5. The flush valve assembly structure of a water tank according to claim 4, wherein the water passage post protrudes from a top surface of the water passage part, a via of the canister flush valve is arc-shaped and extends along a circumferential direction, such that the water passage post of the water passage part has an arc displacement in the via, a baffle protrudes from the inner cylindrical wall at a position at a predetermined distance to the bottom wall, and a block wall is formed on the water passage post corresponding to each water passage post, each block wall extends downward from one end to the other end of the via in an inclined manner, such that the water passage post has an appropriate displacement, so as to change a distance between the water inlet and the block wall.

6. The flush valve assembly structure of a water tank according to claim 4, wherein the water passage post protrudes from a top surface of the through hole, the canister flush valve is arc-shaped and extends along a circumferential direction, such that the water passage post of the water passage part has an arc displacement in the via, a surrounding side wall corresponding to the water passage post extends upward from one end of the via, a block wall is formed on a top surface of the side wall, and the side wall does not extend to the other end of the via, an opening is disposed through the side wall at an appropriate position, such that the water passage post has an appropriate displacement, so as to change a distance between the water inlet and the block wall.

7. The flush valve assembly structure of a water tank according to claim 4, wherein the water passage post protrudes from the bottom wall upwardly, such that the water passage has an appropriate displacement, so as to change an alignment relationship between the water inlet and the block wall.

8. The flush valve assembly structure of a water tank according to claim 4, wherein four corresponding water passage posts and vias are disposed on the water passage part and the canister flush valve respectively.

9. The flush valve assembly structure of a water tank according to claim 4, wherein at least one positioning groove in an arc hole shape and extending along the circumferential direction is disposed through the bottom wall of the canister flush valve at a predetermined position, at least one reverse hook-shaped insertion post correspondingly protrudes from a top surface of the annular portion of the water passage part, and the insertion post passes through the positioning groove and then is engaged with a top surface of the bottom wall for being positioned, and has an arc displacement in the positioning groove.

10. The flush valve assembly structure of a water tank according to claim 9, wherein a slot is cut on a top end of the insertion post, such that the top end of the insertion post is able to be elastically compressed and recovered to expand.

11. The flush valve assembly structure of a water tank according to claim 4, wherein at least one bump is disposed on a periphery of the annular portion of the water passage part, and a plurality of positioning tooth grooves is disposed around a bottom of the canister flush valve at corresponding positions, the positioning tooth grooves are engaged with the bump, such that the water passage part can be rotated in relative to the bottom wall for positioning.

12. The flush valve assembly structure of a water tank according to claim 11, wherein a groove is opened in the annular portion corresponding to the bump, the groove extends inward from an outer edge of the annular portion, and extends for a distance approximately in parallel with the outer edge of the annular portion, such that the bump forms a space for inward elastic deformation.

13. The flush valve assembly structure of a water tank according to claim 4, wherein at least one detent bump for applying a pulling force is disposed on a bottom surface of the annular portion of the water passage part.

14. The flush valve assembly structure of a water tank according to claim 4, wherein an arc protrusion is formed on an inner edge of the water passage post at a position of the water inlet, such that the water inlet is in a shape that gradually expands upward.

15. The flush valve assembly structure of a water tank according to claim 1, wherein the top end of the guide rod comprises a round rod portion to form a round annular wall surface; the round rod portion extends downward to form the guide portion, and a plurality of guide rib plates distributed at equal angles is formed around the guide portion, a guide edge is formed at an edge of each of the guide rid plates, top ends of the guide edges of the guide rib plates connected to the annular wall surface slightly protrude from the annular wall surface radially, and extend upward with small segments on the annular wall surface.

16. The flush valve assembly structure of a water tank according to claim 1, wherein a positioning perforation is disposed through a center of the support rib of the valve seat, the fixing portion on the bottom end of the guide rod is inserted into and limited by the positioning perforation, a locking member is screwed and fixed on a part of the fixing portion extending outside the positioning perforation, and at least one flow path is defined in an inner wall of the longitudinal through hole by the support ribs.

17. The flush valve assembly structure of a water tank according to claim 1, wherein an external screw thread is arranged on a peripheral wall in a lower part of the valve seat, and a locking member is screwed to the external screw thread to lock the valve seat on the bottom wall of the water tank.

18. The flush valve assembly structure of a water tank according to claim 1, wherein a pressing plate extends from a peripheral wall in an upper part of the valve seat radially, and a water proof washer is sleeved on the valve seat, and is caught between a bottom wall surface of the pressing plate and the corresponding bottom wall of the water tank.

19. The flush valve assembly structure of a water tank according to claim 1, wherein a water proof washer is sleeved on a peripheral wall near a bottom end of the canister flush valve, and a bottom wall surface of the water proof washer bears against an upper edge of the longitudinal through hole of the valve seat for sealing.

* * * * *